US008375601B2

(12) United States Patent
Corbett

(10) Patent No.: US 8,375,601 B2
(45) Date of Patent: Feb. 19, 2013

(54) FOOTWEAR WITH AIR CAVITIES

(75) Inventor: Mike Corbett, Bath (GB)

(73) Assignee: C. & J. Clark America, Inc., Newton Upper Falls, MA (US)

( * ) Notice: Subject to any disclaimer, the term of this patent is extended or adjusted under 35 U.S.C. 154(b) by 587 days.

(21) Appl. No.: 12/637,151

(22) Filed: Dec. 14, 2009

(65) Prior Publication Data

US 2011/0138653 A1 Jun. 16, 2011

(51) Int. Cl.
*A43B 7/06* (2006.01)
*A43B 13/20* (2006.01)

(52) U.S. Cl. ..... 36/3 B; 36/59 R; 36/29

(58) Field of Classification Search ..... 36/3 B, 36/59 R, 3 R, 29, 103, 25 R
See application file for complete search history.

(56) References Cited

U.S. PATENT DOCUMENTS

| | | | | | |
|---|---|---|---|---|---|
| 4,063,371 | A * | 12/1977 | Batra | 36/3 B |
| 4,102,061 | A * | 7/1978 | Saaristo | 36/28 |
| 4,319,412 | A | 3/1982 | Muller et al. | |
| 4,547,978 | A * | 10/1985 | Radford | 36/3 B |
| 5,400,526 | A * | 3/1995 | Sessa | 36/3 B |
| 5,815,949 | A | 10/1998 | Sessa | |
| 6,237,249 | B1 * | 5/2001 | Aguerre | 36/11.5 |
| 6,581,303 | B1 * | 6/2003 | Tuan | 36/3 B |
| 6,751,890 | B1 | 6/2004 | Tsai | |
| 2005/0005473 | A1 * | 1/2005 | Oh | 36/29 |

FOREIGN PATENT DOCUMENTS

| | | | |
|---|---|---|---|
| EP | 0122985 | A1 | 10/1984 |
| EP | 1457125 | A1 | 9/2004 |
| WO | 2005051115 | A1 | 6/2005 |

OTHER PUBLICATIONS

European Search Report; EP 09 15 1269; Apr. 29, 2009; 3 pages.

* cited by examiner

*Primary Examiner* — Ted Kavanaugh
(74) *Attorney, Agent, or Firm* — St. Onge Stewart Johnston & Reens LLC

(57) ABSTRACT

There is provided a sole unit having a midsole section and an outsole section. The midsole incorporates a number of cavities which open at their top ends and which are wider at their bottom ends. The outsole section incorporates a number of diaphragm elements which close off the bottoms of the cavities. In some arrangements there is a footbed which has in its underside a number of recesses disposed above each of the cavities, the recesses being linked by channels and incorporating orifices leading to the inside of an article of footwear.

22 Claims, 8 Drawing Sheets

FOOTWEAR WITH AIR CAVITIES

FIELD OF THE INVENTION

This invention relates to footwear and more particularly to sole units for boots and shoes.

BACKGROUND OF THE INVENTION

Radford, EP 0122985 entitled "Improvements Relating to Footwear" discloses a sole unit molded from a resilient material, in which sole unit is provided a plurality of cavities and a system of channels formed in the upper surface of the sole unit which interconnect the cavities. At the lower end of each cavity a bulge extends downwardly from the bottom surface of the sole unit at the location of each cavity, so that the pressure exerted by the foot on any bulge expels air from the associated cavity, and the action of walking pumps air from one cavity to another along the channels and in this way absorbs the shocks of impact of the foot with the ground. The cavities are formed substantially wholly in the general thickness of the sole unit.

SUMMARY OF THE INVENTION

According to the present invention, there is provided a sole unit for an article of footwear comprising a midsole section and an outsole section, the midsole section having formed therein a plurality of cavities each of which is open at its top end and is of smaller cross-sectional area at said top end than its bottom end, the outsole section incorporating a plurality of diaphragm elements, each of which closes off the bottom of one of the cavities and is capable of resiliently deflecting relative to its associated cavity to effect a pumping action therein.

Usually, the sole unit also comprises a footbed disposed above the midsole section, the footbed having a through orifice at the location of the top opening of each cavity. Preferably, the footbed has a number of channels in its underside, said channels interconnecting the cavities of the sole unit. Often, further through orifices lead from the channels to the top side of the footbed and also the area of the underside of the footbed surrounding each orifice is concave.

In preferred arrangements the cross-sectional area of each cavity continually reduces towards its top end and preferably the cavities are substantially frusto-conical. Conveniently, each diaphragm is defined by a reduced thickness periphery and in addition the lower surface of each diaphragm is domed downwardly so as to protrude below the surrounding portions of the outsole section.

With some preferred embodiments, the midsole section is formed from a different material to the outsole section. Preferably, the midsole section is formed separately from and is secured to the outsole section. Sometimes the outsole section is formed from a plurality of separate portions which are attached to the midsole section. Preferably, the outsole section is not continuous over the entire footprint of the sole unit.

It is also possible that valve means are provided to control air flow through and/or between the cavities. In some sole units, the diaphragms are transparent or semi-transparent.

BRIEF DESCRIPTION OF THE DRAWINGS

Embodiments of the present invention will now be described by way of example. The description makes reference to the accompanying drawings in which.

DETAILED DESCRIPTION OF THE INVENTION

Figure 1:
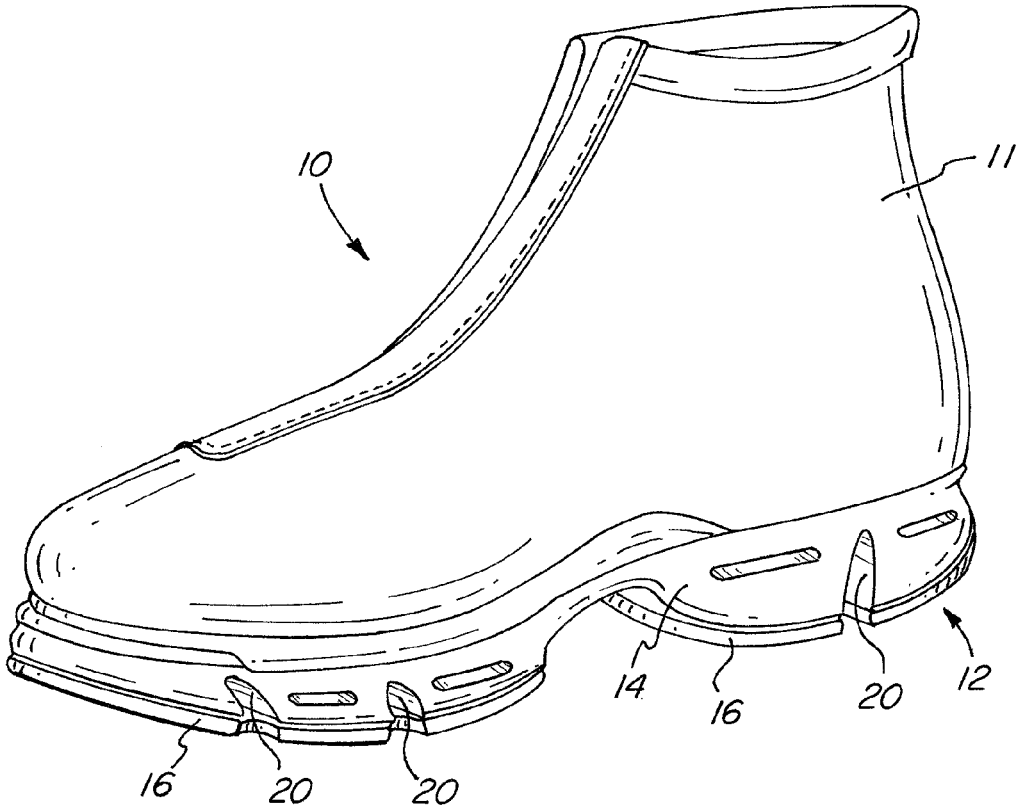
FIG. 1 is a side perspective view of an article of footwear incorporating a sole unit according to the present invention.
Figure 2:
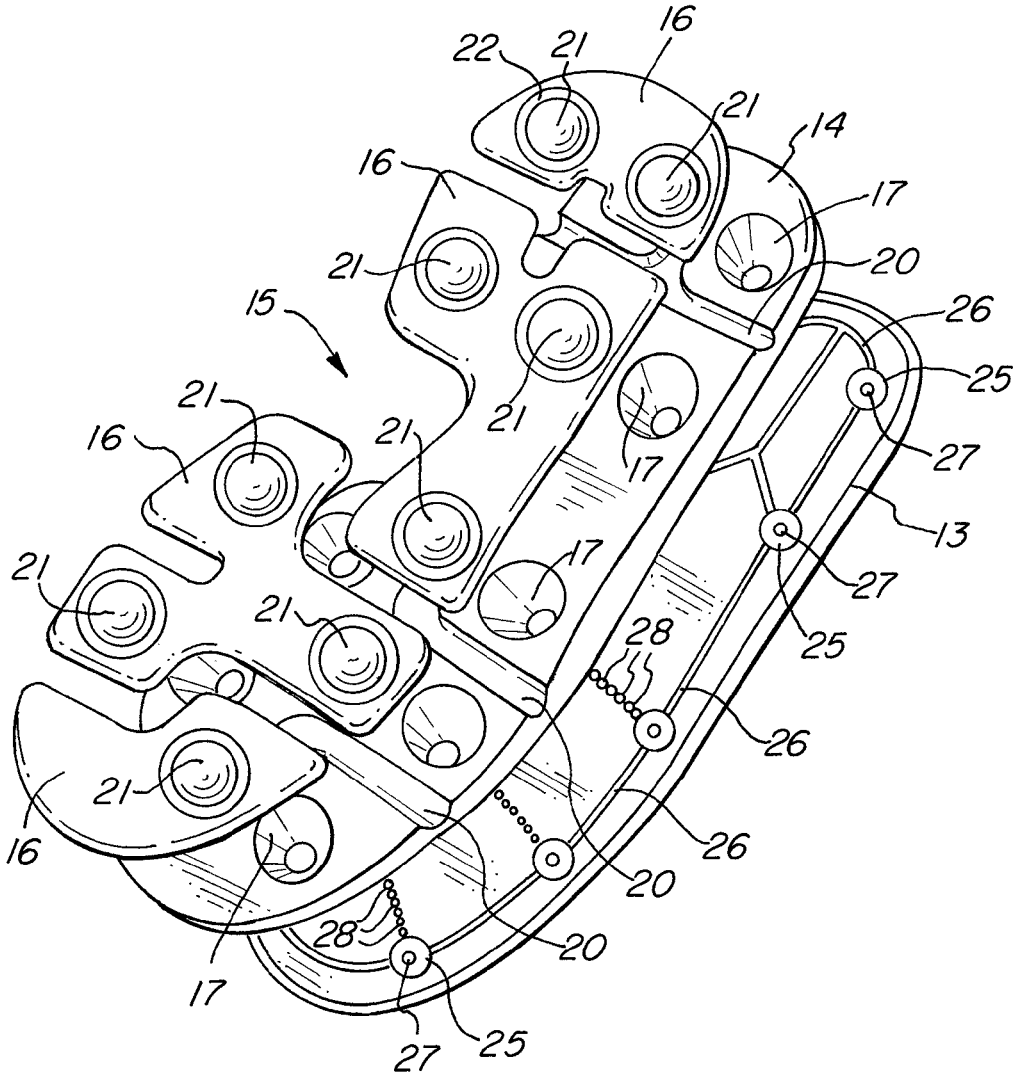
FIG. 2 is an exploded view from below of the sole unit shown in FIG. 1.
Figure 3:
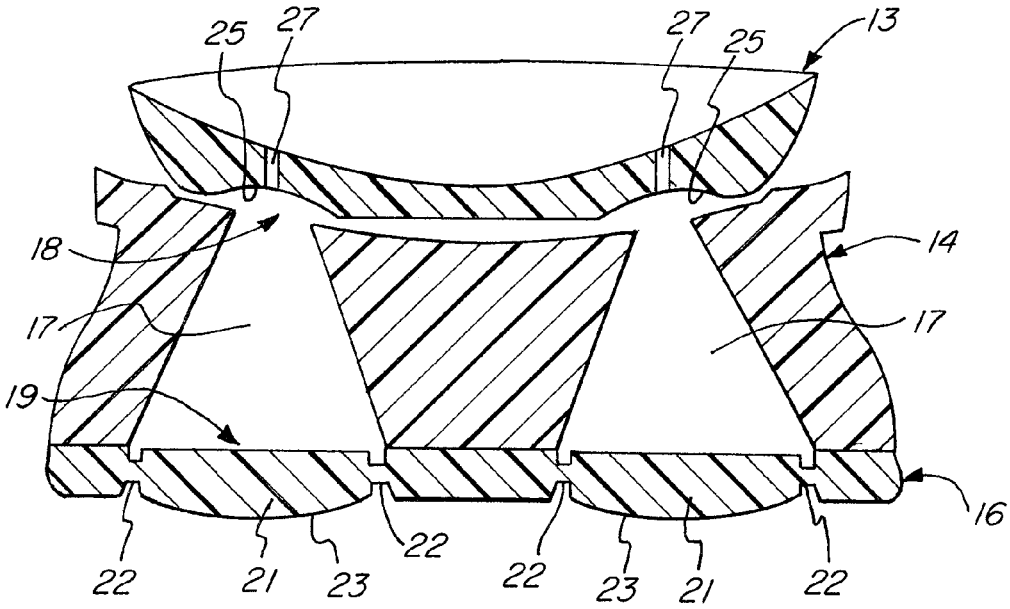
FIG. 3 is a lateral cross-sectional view through the assembled sole unit of FIG. 2.

Referring to the drawings, there is shown an article of footwear 10 having an upper 11 secured to a sole unit 12. In this arrangement, the sole unit comprises a footbed 13, a midsole section 14 and an outsole section 15. The footbed 13 is molded from a resilient plastics material such as polyurethane but other materials could also be used. In this arrangement, the midsole section is molded from a resilient plastics material such as EVA but again other materials would be suitable. The outsole section 15 comprises a number of natural rubber or synthetic rubber outsole portions 16 but a continuous outsole could also be used, as could other materials. This particular rubber compound has a Shore hardness of between 55 and 65 but other hardnesses could be employed depending on the required characteristics of the footwear. The use of separate outsole portions 16 can also lend itself to the provision of different materials in different parts of the outsole section 15 to produce varied wear/comfort characteristics.

The midsole section 14 has a plurality of frusto-conical cavities 17 each of which has a small opening at its top end 18 and a wider opening at its bottom end 19. In addition, there are a number of optional grooves 20 in the underside of the midsole section 14, the grooves improving the flexibility of the sole unit in chosen areas and giving an element of decoration. The outsole portions 16 are securely bonded to the underside of the midsole section and the outsole portions 16 are shaped so as not to cover the grooves 20.

The parts of the outsole portions 16 which cover the bottom ends 19 of the cavities 17 are in the form of diaphragms 21 each of which connects to the surrounding part of outsole portion 16 by means of a peripherally extending portion 22 of reduced thickness. Each reduced thickness portion 22 enables its enclosed diaphragm 21 to resiliently deflect more easily relative to its adjacent cavity 17. The lowermost surface 23 of each diaphragm bulges downwardly so as to protrude below the surrounding parts of the outsole portion 16.

Figure 8:
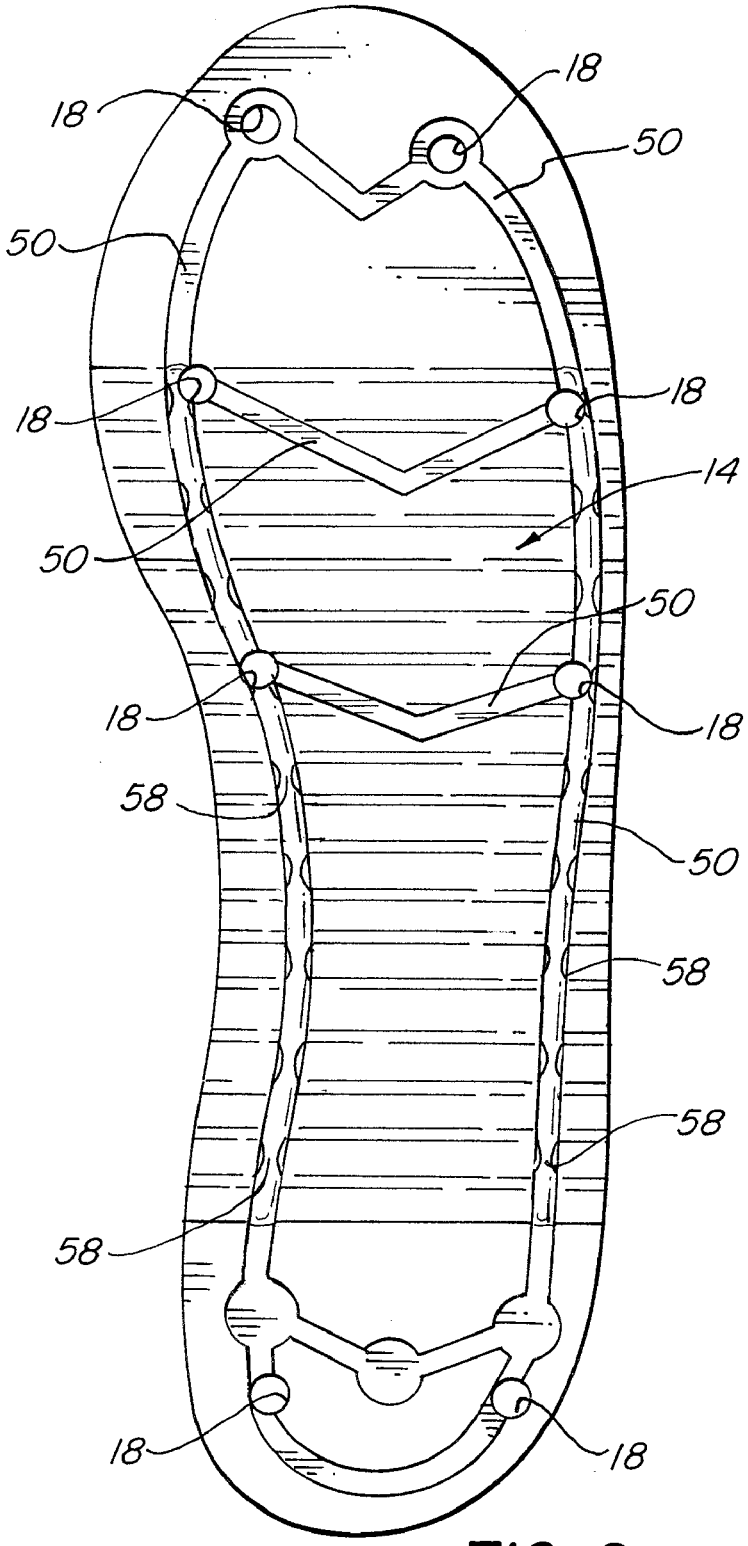
FIG. 8 is a top plan view of the upper surface of the midsole section of the sole unit of FIG. 7, which has a plurality of channels corresponding to the channels in the footbed lower surface of FIG. 9.
Figure 9:
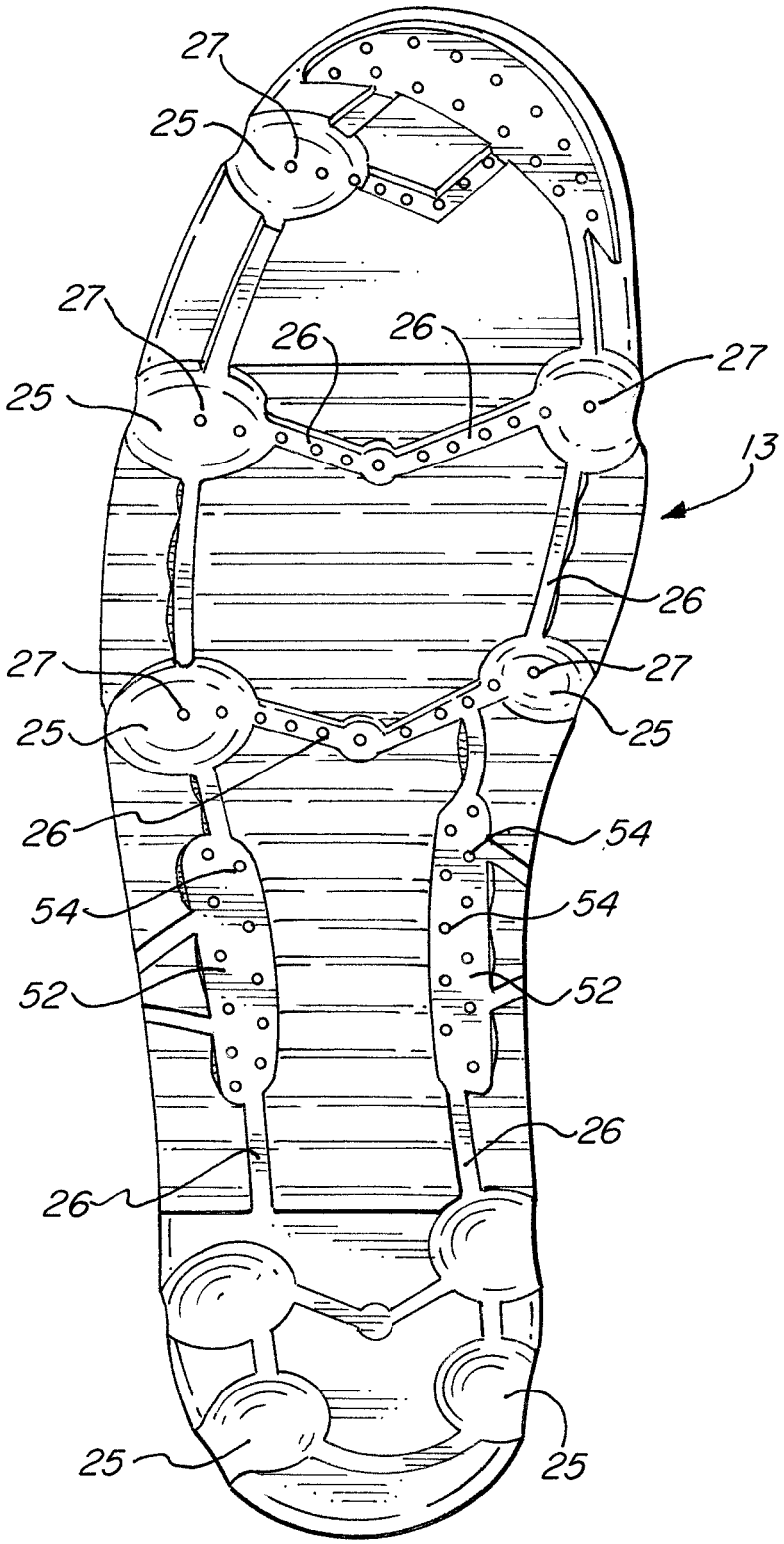
FIG. 9 is a bottom plan view of the lower surface of a footbed, which has a plurality of interconnecting channels corresponding to the plurality of channels of FIG. 8.
Figure 10:
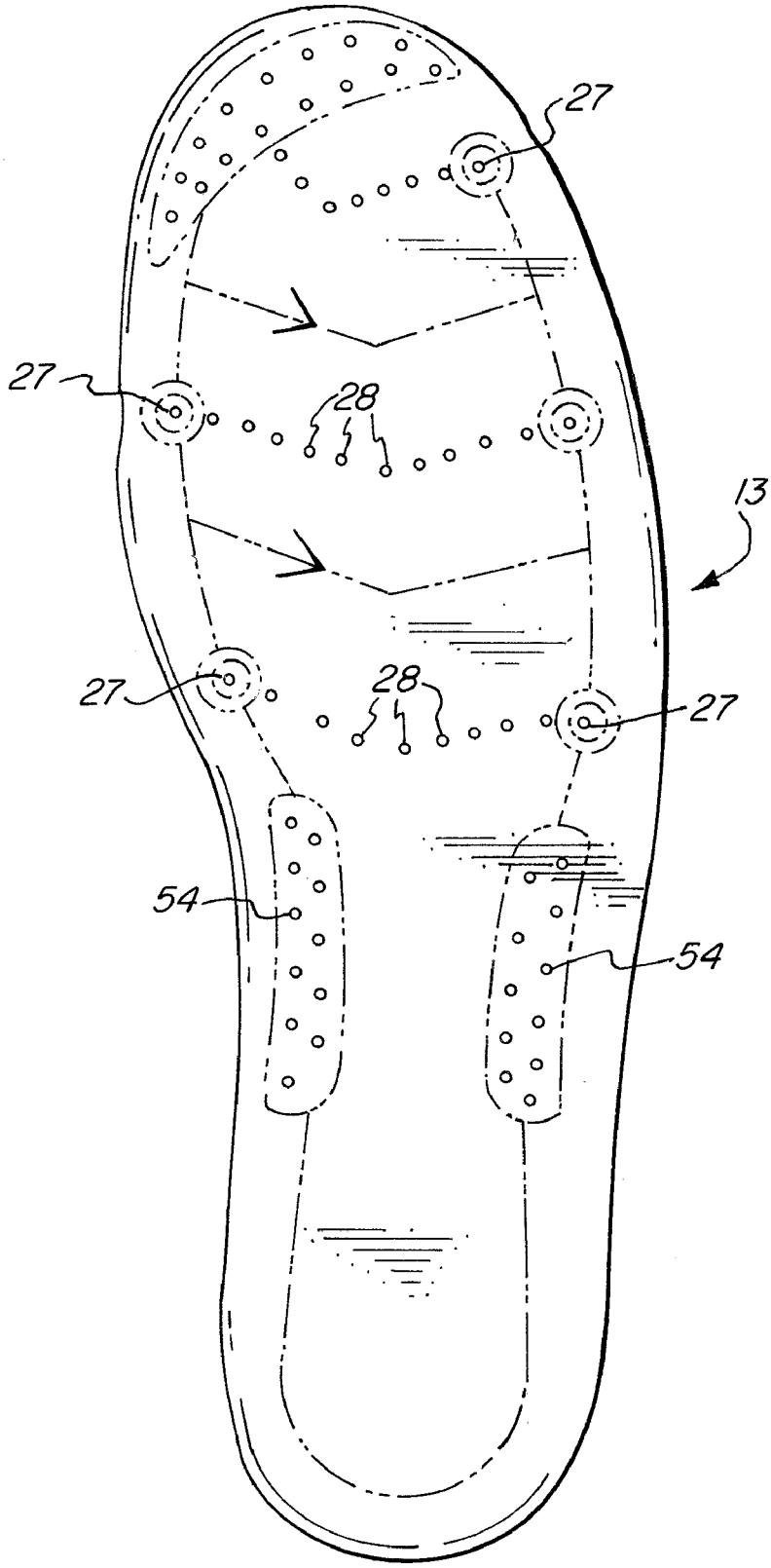
FIG. 10 is a top plan view of the upper surface of the footbed of FIG. 9.

The underside of the footbed 13 has a concave recess 25 positioned above each cavity top end 18 and the recesses 25 are interconnected by means of a plurality of channels 26 formed in the underside of the footbed. In alternative embodiments the plurality of channels are provided in the upper surface of the midsole, or in both the underside of the footbed and the upper surface of the midsole. Alternatively, as seen in FIGS. 8 and 9, the plurality of channels 26 are provided in the underside of the footbed 13 and a plurality of corresponding channels 50 are provided in the upper surface of the midsole section 14. Also, cavities 52 may be provided in the footbed 13 in fluid communication with the channels 26.

A through orifice 27 is provided at each recess 25 to effect communication with the top side of the footbed. Further orifices 28 are provided in the channels 26. Additional through orifices 54 may be provided to extend from cavities 52 in the footbed to the upper surface of the footbed 13. The action of walking causes the diaphragms 21 to deform resiliently upwards into the cavities 17 and back again thereby pumping air from cavity to cavity via the channels 26 and recesses 25. This action also causes air to flow through the orifices 27 and 28 to provide a ventilating effect within the upper 11 of the article of footwear.

In one preferred embodiment, as seen in FIGS. 8 and 9, the underside of the footbed 13 and the upper surface of the midsole section 14 are provided with a mating corrugated surfaces comprised of a plurality of interfitting ribs. The use of such a mating surface assists to keep alignment of the above described elements of the footbed 13 and the midsole section 14. Where mating corrugated surfaces are used, a constant depth of the channels 50 can be obtained by providing a plurality of channel structures 58 in the dips between ribs of the corrugated surface of the upper surface of the midsole section 14.

In more advanced embodiments, valve means may be provided to control the flow of air into and/or out of the cavities, or through the orifices 27, 28, or along the channels 26. The valve means could be one-way mechanisms or could rely on compressive closure of the openings due to weight transfer during the walking cycle.

Figure 4:
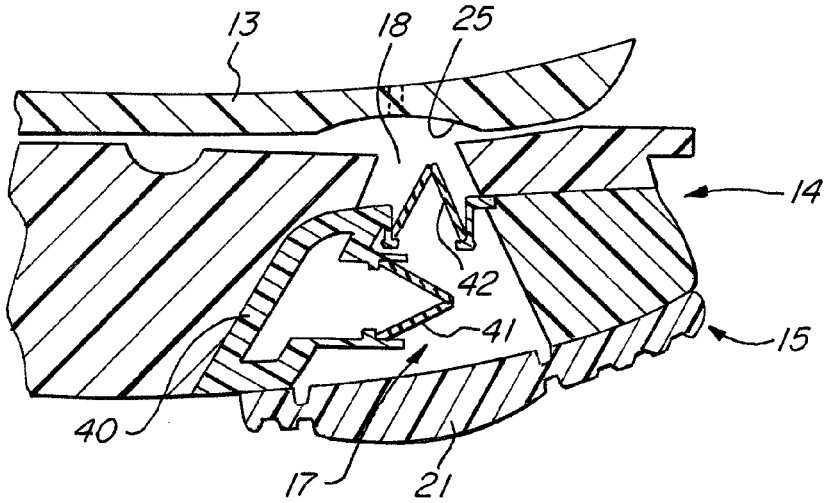
FIG. 4 is a lengthwise cross-sectional view through the heel part of an alternative sole unit according to the present invention.
Figure 5:
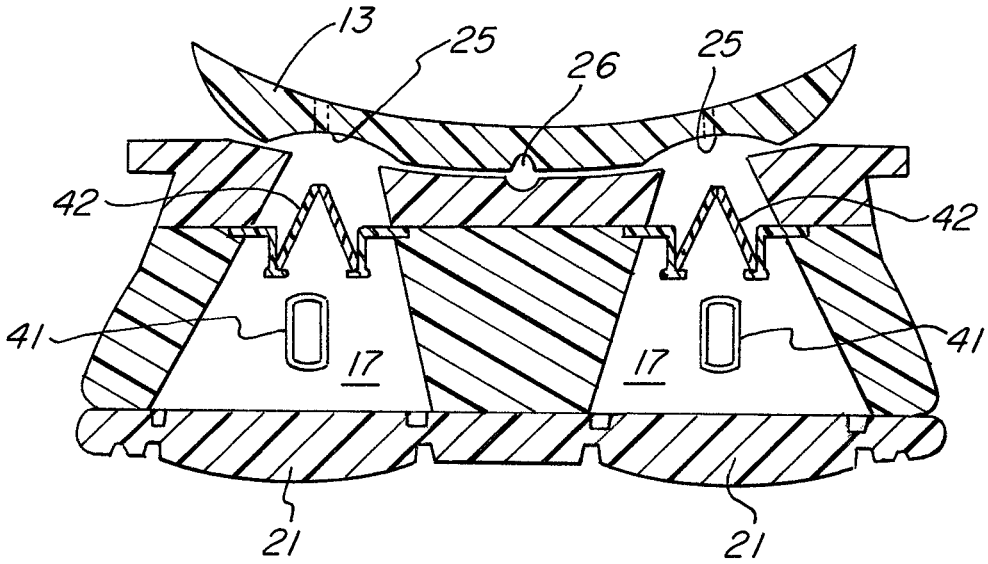
FIG. 5 is a lateral cross-sectional view through the heel part shown in FIG. 4.
Figure 6:
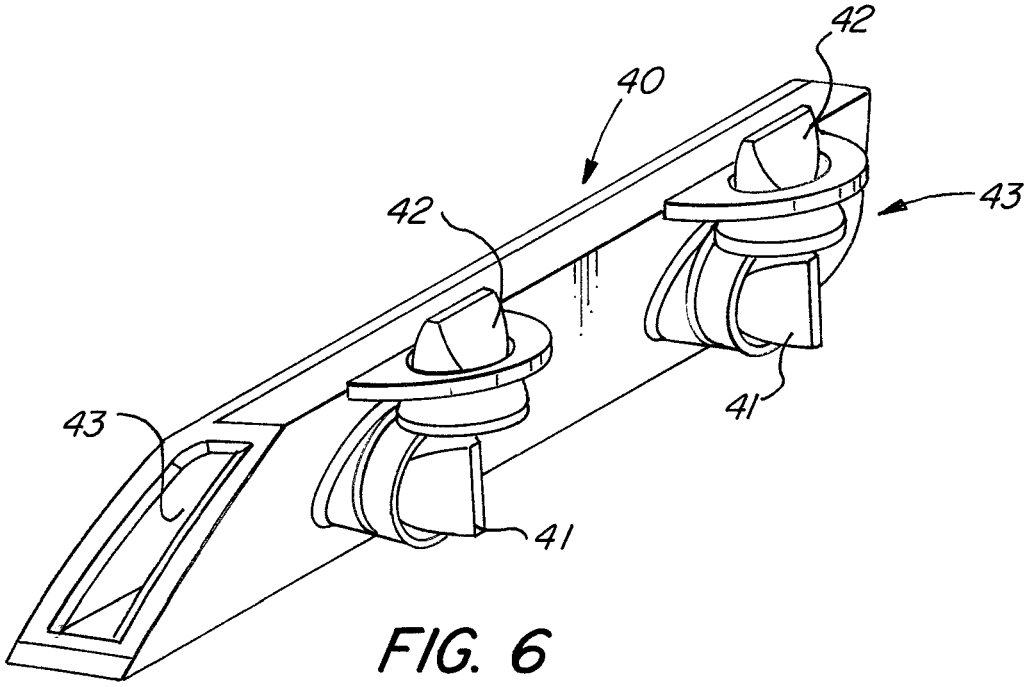
FIG. 6 is a perspective view of a valve insert shown in FIGS. 4 and 5.
Figure 7:
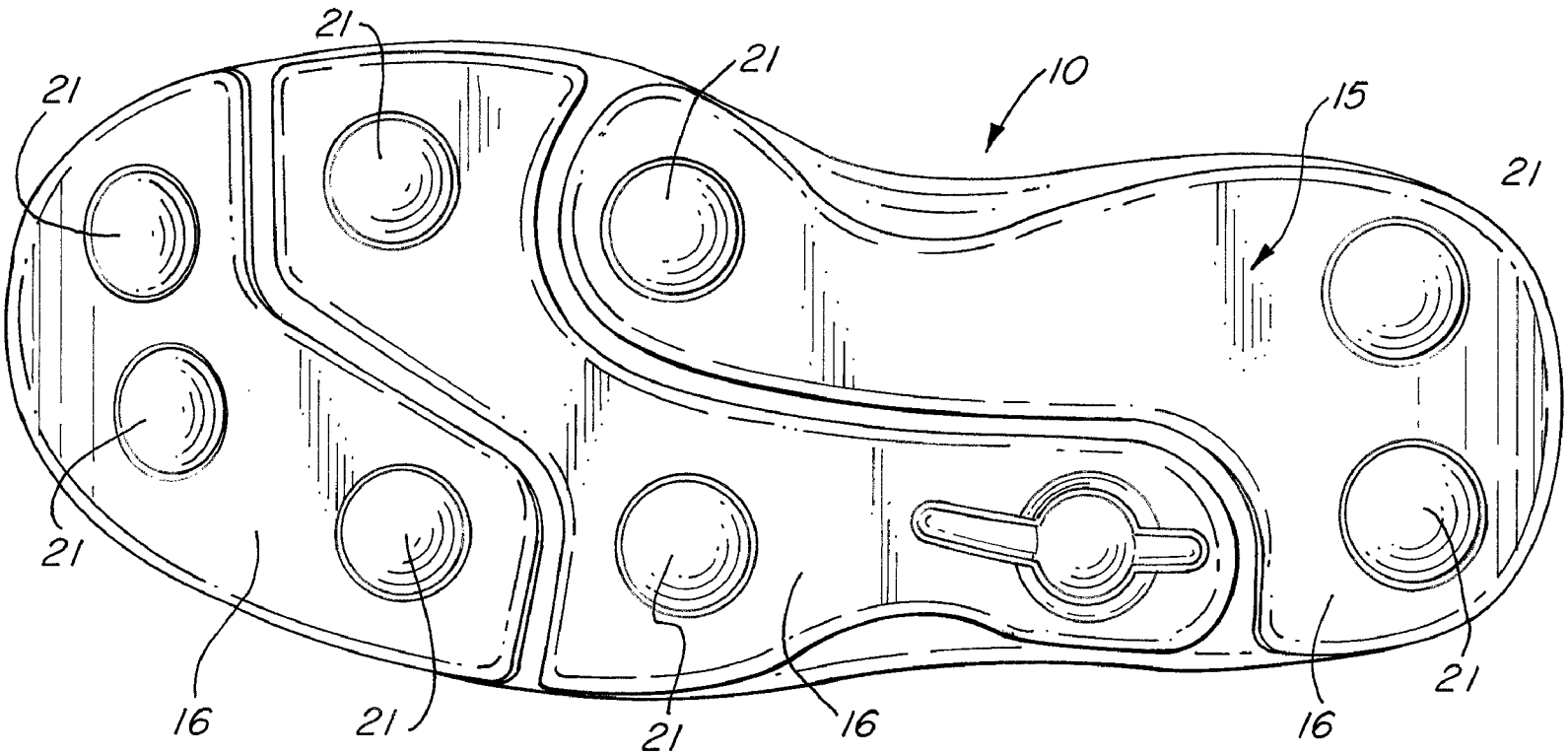
FIG. 7 is a bottom plan view of another embodiment of a sole unit in accordance with the invention.

One example of a sole unit having a valve arrangement is shown in FIGS. 4 to 6. The heel area of the sole unit incorporates an air inlet member 40 which is located generally in the midsole section 14 and which extends laterally in this embodiment. The inlet member 40 is generally tubular and is open to the atmosphere at one or both of its lateral ends 43. The inside of the inlet member 40 communicates with two of the cavities 17 in the heel area via one-way valves 41. In this embodiment the one-way valves 41 are in the form of "duck-bill" valves but other types of valves are envisaged. Air can therefore be drawn into the cavities 17 by suction when the diaphragms 21 deform resiliently downwards. The cavities 17 also have one-way valves 42 which control communication with the recesses 25/channels 26. Again, in this example the one-way valves 42 are "duck-bill" valves which are ideally carried by the inlet member 40.

Fresh air drawn into the cavities 17 as the diaphragms 21 deform downwards is then passed outwardly through the valves 42 when the diaphragms 21 deform upwardly into the cavities 17. This fresh air is distributed around the sole unit and out through orifices 27 and 28 (not shown in FIGS. 5 and 6). This passage of air can assist ventilation of the shoe and/or can provide a cooling action and/or can assist in the dispersal of moisture and/or odor.

The precise form and location of the valve system is a matter of design choice and could be provided for more cavities than the two shown. The inlet member and valves need not be separate components but could be molded as part of the midsole.

In other embodiments, the diaphragms 21 could be formed of a transparent or semi-transparent material such that the inside of the cavities/underside of the footbed can be seen. Contrasting colors in the cavity could produce a desirable decorative effect.

It will be appreciated that the number of cavities could vary as could their precise shape. Also, the reduced thickness portions 22 which define the shapes of the diaphragms could be omitted or partially omitted if the material of the outsole was already sufficiently flexible. The footbed could be omitted in some types of footwear, for example where an insole is lasted to the upper in which case the midsole would be secured to the lasting margin of the upper. Other modifications will be apparent without departing from the scope of the attached claims.

What is claimed is:

1. A sole unit for an article of footwear comprising:

a midsole section having formed therein a plurality of substantially frustoconical cavities each of which is open at its top end and is of smaller cross-sectional area at said top end than its bottom end, wherein each said cavity extends through the entire thickness of the midsole section wherein the cross-sectional area of the cavity is tapered such that the cross-sectional area of the cavity continuously reduces from the cavity lower end to the cavity upper end;

a footbed disposed above the midsole section, said footbed having a top side and an underside, the underside having concave areas located above the open top ends of the plurality of cavities, and having through orifices extending from the concave areas to the top side of the footbed; and an outsole section incorporating a plurality of resiliently deflectable diaphragm elements, the diaphragm elements being positioned at the bottom end of the midsole cavities, the diaphragm elements closing off the bottom of the cavities and being capable of resiliently deflecting relative to the cavities to effect a pumping action therein, lower surfaces of the diaphragms being domed downwardly so as to protrude below surrounding portions of the outsole section.

2. The sole unit of claim 1, wherein mating corrugated surfaces, comprised of a plurality of interfitting ribs, are provided on the underside of the footbed and an upper surface of the midsole section to align the footbed and midsole section.

3. The sole unit of claim 1 , wherein the footbed has a number of channels in its underside, said channels interconnecting the cavities of the sole unit.

4. The sole unit of claim 3, wherein further through orifices lead from the channels to the top side of the footbed.

5. The sole unit of claim 1, wherein each diaphragm is defined by a reduced thickness periphery.

6. The sole unit of claim 1, wherein the midsole section is formed from a different material to the outsole section.

7. The sole unit of claim 6, wherein the midsole section is formed separately from and is secured to the outsole section.

8. The sole unit of claim 7, wherein the outsole section is formed from a plurality of separate portions which are attached to the midsole section.

9. The sole unit of claim 7, wherein the outsole section is not continuous over the entire footprint of the sole unit.

10. The sole unit of claim 1 further comprising valve means provided to control air flow through and/or between the cavities.

11. The sole unit of claim 10 wherein one or more of the cavities communicate with the atmosphere via one or more one-way valves.

12. The sole unit of claim 1, wherein the diaphragms are transparent or semi-transparent.

13. A sole unit for an article of footwear comprising:

a midsole section having an upper surface and a lower surface, the midsole section containing a plurality of substantially frustoconical cavities extending through the thickness of the midsole section, having a cross-sectional area which is larger at the cavity lower ends and smaller at a cavity upper ends, wherein the cross-sectional area of the cavities are tapered such that the cross-sectional area of the cavities continuously reduces from the cavity lower ends to the cavity upper ends, said cavities being open at their cavity upper ends;

an outsole section affixed to the lower surface of the midsole section, incorporating a plurality of resilient diaphragm elements, the diaphragm elements being positioned at the cavity lower ends and closing the cavity lower ends;

wherein each of said diaphragm elements is defined by a flat upper surface, a downwardly protruding lower surface and a reduced thickness periphery along both the upper and lower surfaces, and is capable of resiliently deflecting relative to its associated cavity to effect a pumping action therein.

14. The sole unit of claim 13, further comprising a footbed having a lower surface and an upper surface, said footbed lower surface being located above the upper surface of the midsole section, the footbed having one or more through orifices extending through the footbed from the footbed lower surface to the footbed upper surface, with the through orifices located in fluid communication with the open cavity upper ends.

15. The sole unit of claim 14, wherein the through orifices are located at the open cavity upper ends.

16. The sole unit of claim 14, wherein one or both of the footbed lower surface and the midsole section upper surface have a plurality of channels interconnecting the open cavity upper ends.

17. The sole unit of claim 16, wherein a plurality of further through orifices extend through the footbed from the plurality of channels to the footbed upper surface.

18. The sole unit of claim 17, wherein concave recesses and the plurality of channels are provided in the footbed lower surface adjacent at the location of the open cavity upper ends.

19. The sole unit of claim 16, wherein the diaphragms are transparent or semi-transparent.

20. The sole unit of claim 16, wherein the midsole section upper surface has a plurality of channel supporting structures interconnecting the open cavity upper ends corresponding to the channels in the footbed lower surface.

21. The sole unit of claim 14, wherein mating corrugated surfaces, comprised of a plurality of interfitting ribs, are provided on the lower surface of the footbed and the upper surface of the midsole section to assist in alignment of the footbed and midsole section.

22. A sole unit for an article of footwear comprising:

a footbed having a plurality of orifices at an upper portion of the footbed and concave recesses on a lower surface of the footbed, the orifices and recesses being aligned with reach other;

a midsole located below the footbed, the midsole having a plurality of frustoconical cavities having a cross-sectional area, each cavity being open at a top end and of smaller cross-sectional area at said top end than at a bottom end, wherein each cavity extends through the entire thickness of the midsole wherein the cross-sectional area of the cavity is tapered such that the cross-sectional area of the cavity continuously reduces from the cavity lower end to the cavity upper end, and each cavity upper end aligns with a concave recess on the footbed lower surface;

an outsole located below the midsole, the outsole having a plurality of resiliently deflectable diaphragm elements, each of which closes off the bottom of one of the cavities and which has a downwardly protruding lower surface and a reduced thickness periphery and provides a pumping action in its associated cavity by resiliently deflecting relative to the associated cavity.

* * * * *